US012735860B1

(12) United States Patent
Dauderman et al.

(10) Patent No.: US 12,735,860 B1
(45) Date of Patent: Sep. 15, 2026

(54) AUTOMATIC BLADE PITCH ADJUSTMENT FOR DOZER

(71) Applicant: Deere & Company, Moline, IL (US)

(72) Inventors: Bradley C. Dauderman, Dubuque, IA (US); Cory J. Brant, Dubuque, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 19/210,208

(22) Filed: May 16, 2025

(51) Int. Cl.
*E02F 3/84* (2006.01)
*E02F 3/04* (2006.01)

(52) U.S. Cl.
CPC ..... *E02F 3/844* (2013.01)

(58) Field of Classification Search
CPC ..... E02F 3/04; E02F 3/84; E02F 3/844; E02F 3/845
See application file for complete search history.

(56) References Cited

U.S. PATENT DOCUMENTS

| | | | |
|---|---|---|---|
| 4,945,221 | A | 7/1990 | Nielsen et al. |
| 5,493,798 | A | 2/1996 | Rocke et al. |
| 6,247,538 | B1 | 6/2001 | Takeda et al. |
| 6,477,914 | B1 | 11/2002 | Krieger |
| 6,736,216 | B2 | 5/2004 | Savard et al. |
| 7,477,973 | B2 | 1/2009 | Brewer et al. |
| 7,934,329 | B2 | 5/2011 | Mintah et al. |
| 8,141,650 | B2 | 3/2012 | Breiner et al. |
| 8,180,532 | B2 | 5/2012 | O'Halloran et al. |
| 8,634,991 | B2 | 1/2014 | Douglas |
| 8,689,471 | B2 | 4/2014 | Carpenter et al. |
| 8,919,455 | B2 | 12/2014 | Hendron et al. |
| 9,074,546 | B2 | 7/2015 | Asami et al. |
| 9,187,879 | B2 | 11/2015 | Suk |
| 9,234,329 | B2 | 1/2016 | Jaliwala et al. |
| 9,328,479 | B1 | 5/2016 | Rausch et al. |
| 9,347,389 | B2 | 5/2016 | Tadashi et al. |
| 9,428,885 | B2 | 8/2016 | Nau |
| 9,551,130 | B2 | 1/2017 | Hendron et al. |
| 9,624,643 | B2 | 4/2017 | Hendron et al. |
| 9,638,525 | B1 | 5/2017 | Willis |
| 9,976,285 | B2 | 5/2018 | Padilla |
| 9,995,016 | B1 | 6/2018 | Howell et al. |
| 10,094,654 | B2 | 10/2018 | Crozier et al. |

(Continued)

FOREIGN PATENT DOCUMENTS

| | | | |
|---|---|---|---|
| WO | 2008129345 | A1 | 10/2008 |
| WO | 2012157381 | A1 | 11/2012 |

*Primary Examiner* — Tan Q Nguyen
(74) *Attorney, Agent, or Firm* — Jerry T. Sewell; Lucian Wayne Beavers; Patterson Intellectual Property Law, PC

(57) ABSTRACT

A system and a method detect an initial movement of a work machine having a blade. The pitch of the blade is automatically adjusted such that a cutting edge of the blade is at a cutting angle with respect to the surface to enable initiation of a cut below a track plane by the cutting edge. When the cutting edge is elevated to or above the track plane, the pitch of the blade is automatically adjusted to a carry angle. When the cutting edge rises at least a selected distance above the track plane, the pitch of the blade is automatically adjusted to a shedding angle. When the work machine is cutting, the system and method detect bridging of the work machine and automatically reduce the angle of the blade to counter the bridging effect.

14 Claims, 8 Drawing Sheets

(56) References Cited

U.S. PATENT DOCUMENTS

| | | | | |
|---|---|---|---|---|
| 10,401,176 | B2 | 9/2019 | Nackers et al. | |
| 10,532,741 | B2 | 1/2020 | Kean et al. | |
| 10,704,233 | B2 | 7/2020 | Dusha | |
| 10,883,248 | B2 | 1/2021 | Stotlar | |
| 11,414,839 | B2 | 8/2022 | Shintani et al. | |
| 2008/0047170 | A1 | 2/2008 | Nichols | |
| 2011/0311342 | A1 | 12/2011 | Montgomery | |
| 2013/0080112 | A1 | 3/2013 | Friend | |
| 2013/0103247 | A1 | 4/2013 | Kim | |
| 2014/0168009 | A1 | 6/2014 | Peake | |
| 2014/0343800 | A1 | 11/2014 | Nelson et al. | |
| 2014/0345889 | A1* | 11/2014 | Nakata | E02F 3/847 172/1 |
| 2016/0003171 | A1 | 1/2016 | Ge | |
| 2016/0258128 | A1 | 9/2016 | Nakamura et al. | |
| 2019/0100205 | A1 | 4/2019 | Kean et al. | |
| 2019/0234045 | A1 | 8/2019 | Wiewel et al. | |
| 2020/0042023 | A1 | 2/2020 | Garvin et al. | |
| 2021/0062470 | A1* | 3/2021 | Wei | E02F 9/264 |
| 2021/0189667 | A1 | 6/2021 | Fritz | |
| 2022/0195693 | A1 | 6/2022 | Kalantar et al. | |
| 2023/0358019 | A1* | 11/2023 | Mason | E02F 3/844 |
| 2024/0150996 | A1* | 5/2024 | Tanaka | E02F 9/22 |

* cited by examiner

AUTOMATIC BLADE PITCH ADJUSTMENT FOR DOZER

FIELD OF THE DISCLOSURE

The present disclosure relates generally to dozers having grade control systems and tools that automatically work the ground surface to an elevation. More particularly, the disclosure relates to techniques for automatic adjustment of the pitch of a blade during operational stages.

BACKGROUND

Work machines within the scope of the present disclosure may for example include crawler dozers, wheeled dozers, and other similar self-propelled work machines having a front mounted blade with an adjustable pitch. The work machines have tracks or wheels that operate as ground engaging units that support a frame, an undercarriage, or both above a ground surface. The work machines include an assembly that supports and positions the blade relative to the work machine frame. The blade is positioned in response to control signals from the work machine. The blade engages the ground surface and modifies the terrain of the ground surface based on the position of the blade in coordination with movement of the work machine.

A dozer blade typically includes a main body structure, which can be as simple as a rectangular flat plate having a front surface and a rear surface. The main body structure of the blade has an upper portion and a lower portion. The lower portion of the main body structure of the blade supports a cutting edge that extends from the front surface of the blade. The cutting edge is configured to engage soil or other material on a surface to be modified and to cause the material to be dislodged from the surface. The dislodged material is collected by the main body structure of the blade so that the dislodged material can be moved to another location.

Although the orientation of the main body structure of a dozer blade can be fixed in a generally perpendicular orientation, dozer blades for many large dozers have a variable pitch. Dozers having a variable-pitch blade can incorporate pitch control to enable a dozer operator to control the orientation of the main body structure of the blade and to thereby control an angle at which the cutting edge engages the surface to be modified. The pitch control can be manual (e.g., hand controls that control hydraulic cylinders) or automated. The dozer blade pitches about a pitch pivot axis, which is generally located behind the lower portion of the main body structure of the blade above the level of the cutting edge of the blade. When the blade is pitched forward (e.g., the blade is pivoted to cause the upper portion of the blade to move forward away from the work machine), the lower portion of the blade moves rearward towards the work machine. The rearward movement of the lower portion of the blade causes the angle of the cutting edge of the blade to increase with respect to the surface to be modified. When the blade is pitched rearward (e.g., the blade is pivoted to cause the upper portion of the blade to move rearward toward the work machine), the lower portion of the blade moves forward away from the work machine. The forward movement of the lower portion of the blade causes the angle of the cutting edge of the blade to decrease with respect to the surface to be modified.

Controlling the pitch of the blade enables the operator of the dozer to use the blade for at least three modes of operation. In a first (cutting) mode of operation, the main body structure of the blade is in a nearly vertical orientation with the upper portion of the blade midway between a fully pitched forward position and a fully pitched rearward position. In the cutting mode, the cutting edge of the blade is at a first angle with respect to the surface to be modified. This first angle is selected to allow the blade to penetrate and cut the surface when the operator lowers the blade to position the cutting edge of the blade below the surface. As the dozer moves forward in the cutting mode, dislodged material forces previously discharged material up the surface of the blade After the forward motion of the dozer in the cutting mode has dislodged sufficient material to fill the blade, the pitch of the blade is changed to a second (carry) mode of operation wherein the upper portion of the blade is pitched rearward towards a rearmost position. This pitching movement causes the lower portion of the main body structure to pitch forward. The forward pitch of the lower portion of the blade enables the blade to carry the previously dislodged material as the dozer continues to move forward.

In a third (shedding) mode of operation, the upper portion of the blade is pitched forward towards a forwardmost position of the upper portion and the lower portion of the blade is pitched rearward. The rearward pitch of the lower portion causes the cutting edge to have a greater angle with respect to the surface to be modified in the shedding mode than the angle in either the cutting mode or the carry mode such that the dislodged material is no longer supported by the blade and is allowed to fall from the front surface of the blade and to be deposited at a new location.

The foregoing can be accomplished by an experienced operator by skillful manipulation of the tilt controls of the blade while also controlling the elevation of the blade and controlling the movement of the dozer.

SUMMARY

A need exists for automating the pitching of the dozer blade to relieve the operator of the burden of manipulating the pitch controls while engaged in the positioning the blade and controlling the movement of the dozer.

One aspect of the embodiments disclosed herein is a system and a method of that detect an initial movement of a work machine having a blade. The pitch of the blade is automatically adjusted such that a cutting edge of the blade is at a cutting angle with respect to the surface to enable initiation of a cut below a track plane by the cutting edge. When the cutting edge is elevated to or above the track plane, the pitch of the blade is automatically adjusted to a carry angle. When the cutting edge rises at least a selected distance above the track plane, the pitch of the blade is automatically adjusted to a shedding angle. When the work machine is cutting, the system and method detect bridging of the work machine and automatically increase the angle of the blade to counter the bridging effect.

Another aspect of the embodiments disclosed herein is a computer-assisted method of controlling the pitch of a blade of a work machine. The method comprises initiating movement of the work machine in a forward direction along a surface to be modified by the blade of the work machine. The method further comprises responding to the movement of the work machine by automatically changing the pitch of the blade to a first pitch such that a cutting edge of the blade is at a cutting angle with respect to the surface being modified. The method further comprises lowering the blade to position the cutting edge below an elevation of a track plane to initiate cutting of the surface to be modified. The method further comprises raising the blade to position the cutting edge at the elevation of the track plane. The method further comprises responding to the cutting edge rising to the elevation of the track plane by automatically changing the pitch of the blade to a second pitch such that the cutting edge is at a carry angle with respect to the surface being modified. The method further comprises raising the blade to position the cutting edge above the elevation of the track plane. The method further comprises responding to the cutting edge rising above the elevation of the track plane by automatically changing the pitch of the blade to a third pitch such that the cutting edge is at a shedding angle with respect to the surface being modified.

In certain embodiments in accordance with this aspect, the carry angle is less than the cutting angle and the shedding angle is greater than the cutting angle.

In certain embodiments in accordance with this aspect, the blade is supported at a pivot location of a support structure extending from the work machine. The blade has an upper portion and a lower portion. The upper portion is at a first upper portion position and the lower portion is at a first lower portion position when the blade is at the first pitch. The cutting edge is positioned at the lower portion. Changing the pitch to the second pitch moves the upper portion of the blade to a second upper portion position toward the front of the work machine and positions the lower portion of the blade to a second lower portion position away from the front of the work machine. Changing the pitch to the third pitch moves the upper portion of the blade to a third upper portion position away from the front of the work machine and positions the lower portion of the blade to a third lower portion position toward the front of the work machine. Changing the pitch to the first pitch moves the upper portion of the blade to the first upper portion position between the second upper portion position and the third upper portion position, and moves the lower portion of the blade to the first lower portion position between the second lower portion position and the third lower portion position.

In certain embodiments in accordance with this aspect, the method further comprises detecting bridging of the work machine wherein at least a portion of at least one ground engaging unit of the work machine is elevated above the surface being modified. The method automatically changes the pitch of the blade to increase the angle of the cutting edge and to thereby counter the bridging.

In certain embodiments in accordance with this aspect, the cutting edge of the blade is removably attached to the lower portion of the blade.

Another aspect of the embodiments disclosed herein is a control system for operating a work machine comprising a plurality of ground-engaging units, which support a machine frame and which are driven to cause the work machine to travel across a ground surface. The work machine further comprise a blade supported by a support structure extending from the machine frame. The blade has an upper portion and a lower portion. The lower portion supports a cutting edge configured to sculpt the ground surface along a track plane. The control system further comprises a controller. The controller is configured to receive signals from the work machine indicating the movement of the work machine and signals indicating changes in elevation of the blade; to generate signals to control the work machine and to control the pitch of the blade; to respond to forward movement of the work machine by adjusting the pitch of the blade to a first pitch such that the cutting edge is at a cutting angle with respect to the surface being sculpted; to respond to the elevation of the cutting edge being lowered below the track plane and then being raised to the elevation of the track plane by adjusting the pitch of the blade to a second pitch such that the cutting edge of the blade is at a carry angle with respect to the surface to being sculpted; and to respond to the elevation of the cutting edge rising above the track plane by adjusting the pitch of the blade to a third pitch such that the cutting edge of the blade is at a shedding angle with respect to the surface being sculpted.

In certain embodiments in accordance with this aspect, the carry angle is less than the cutting angle and the shedding angle is greater than the cutting angle.

In certain embodiments in accordance with this aspect, the controller is configured to adjust the pitch of the blade to the second pitch by moving the upper portion of the blade to a rearward upper portion position toward the front of the work machine and by moving the lower portion of the blade to a forward lower portion position away from the front of the work machine; to adjust the pitch of the blade to the third pitch by moving the upper portion of the blade to a forward upper portion position away from the front of the work machine and by moving the lower portion of the blade to a rearward lower portion position toward the front of the work machine; and to adjust the pitch of the blade to the third pitch by moving the upper portion of the blade to a upper portion position between the rearward upper portion position and the forward upper portion position and by moving the lower portion of the blade to a lower portion position between the forward lower portion position and the rearward lower portion position.

In certain embodiments in accordance with this aspect, the controller is further configured to detect bridging of the work machine wherein at least a portion of at least one ground engaging unit of the work machine is elevated above the surface being modified; and to automatically change the pitch of the blade to increase the angle of the cutting edge and thereby counter the bridging.

In certain embodiments in accordance with this aspect, the cutting edge of the blade is removably attached to the lower portion of the blade.

Another aspect of the embodiments disclosed herein is a method of sculpting a surface along a track plane using a cutting edge of a blade of a work machine. The blade is supported by a support structure extending from the work machine. The blade has an adjustable pitch with respect to the support structure that enables the cutting edge of the blade to be adjustable to a selected angle with respect to the surface. The method comprises positioning the work machine to position the cutting edge of the blade proximate to a portion of the surface; initiating forward movement of the work machine along the track plane; responding to the forward movement of the work machine by automatically adjusting the pitch of the cutting edge of the blade to a cutting angle with respect to the surface and lowering the cutting edge into the surface; raising the blade to position the cutting edge at an elevation of the track plane; responding to the cutting edge rising to the elevation of the track plane by automatically adjusting the cutting edge of the blade to a carry angle with respect to the surface; raising the cutting edge to an elevation above the elevation of the track plane; and responding to the cutting edge rising about the track plane by automatically adjusting the cutting edge to a shedding angle.

In certain embodiments in accordance with this aspect, the carry angle is less than the cutting angle and the shedding angle is greater than the cutting angle.

In certain embodiments in accordance with this aspect, the method further comprises detecting bridging of the work machine wherein at least at portion of at least one ground engaging unit of the work machine is elevated above the surface being modified. The method automatically pivots the blade to increase the angle of the cutting edge and thereby counter the bridging.

In certain embodiments in accordance with this aspect, the cutting edge of the blade is removably attached to the lower portion of the blade.

Numerous objects, features, and advantages of the embodiments set forth herein will be readily apparent to those skilled in the art upon reading of the following disclosure when taken in conjunction with the accompanying drawings.

DETAILED DESCRIPTION

Figure 1:
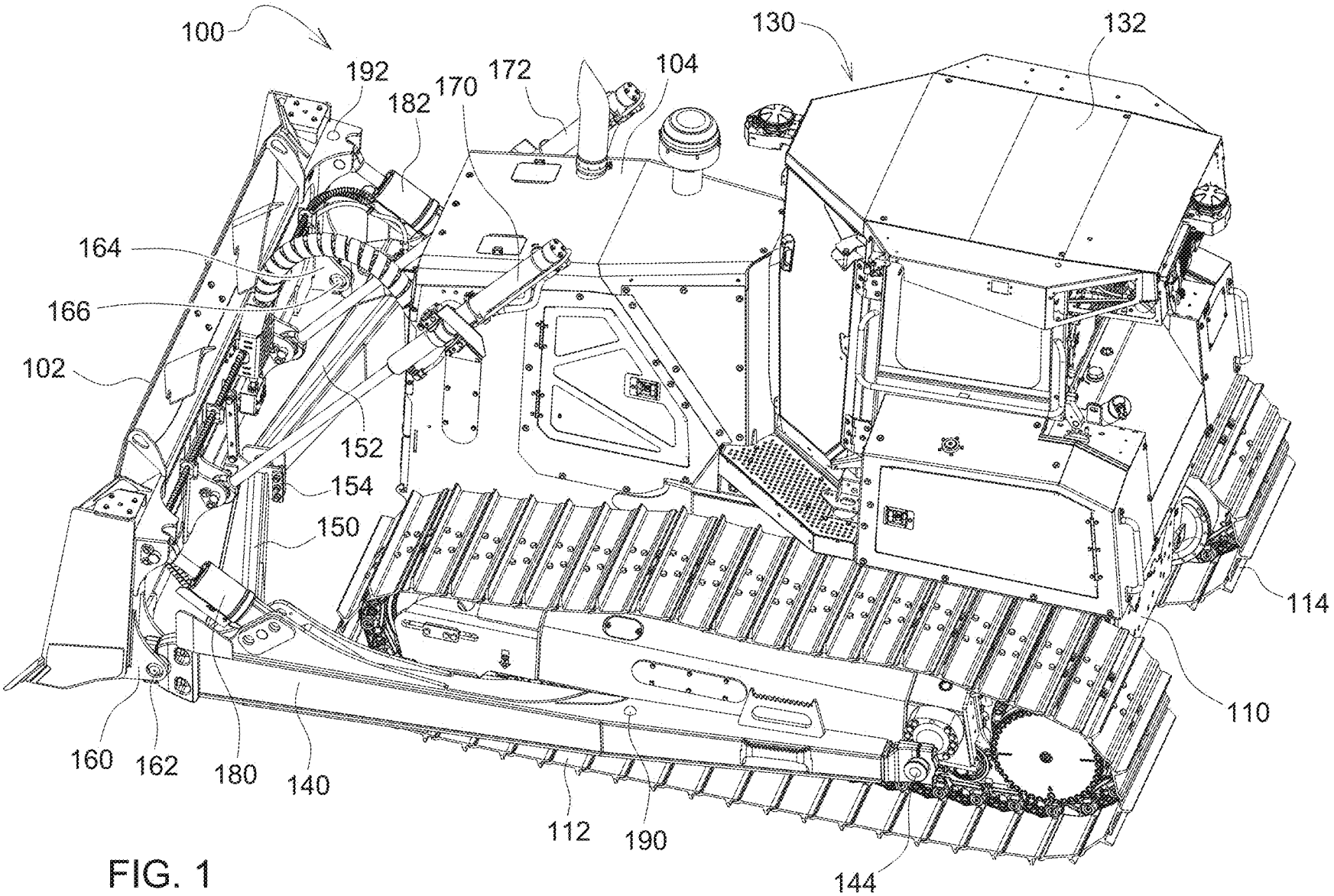
FIG. 1 is a perspective view of a work machine incorporating or otherwise implementing an embodiment of a system and method as disclosed herein.
Figure 2:
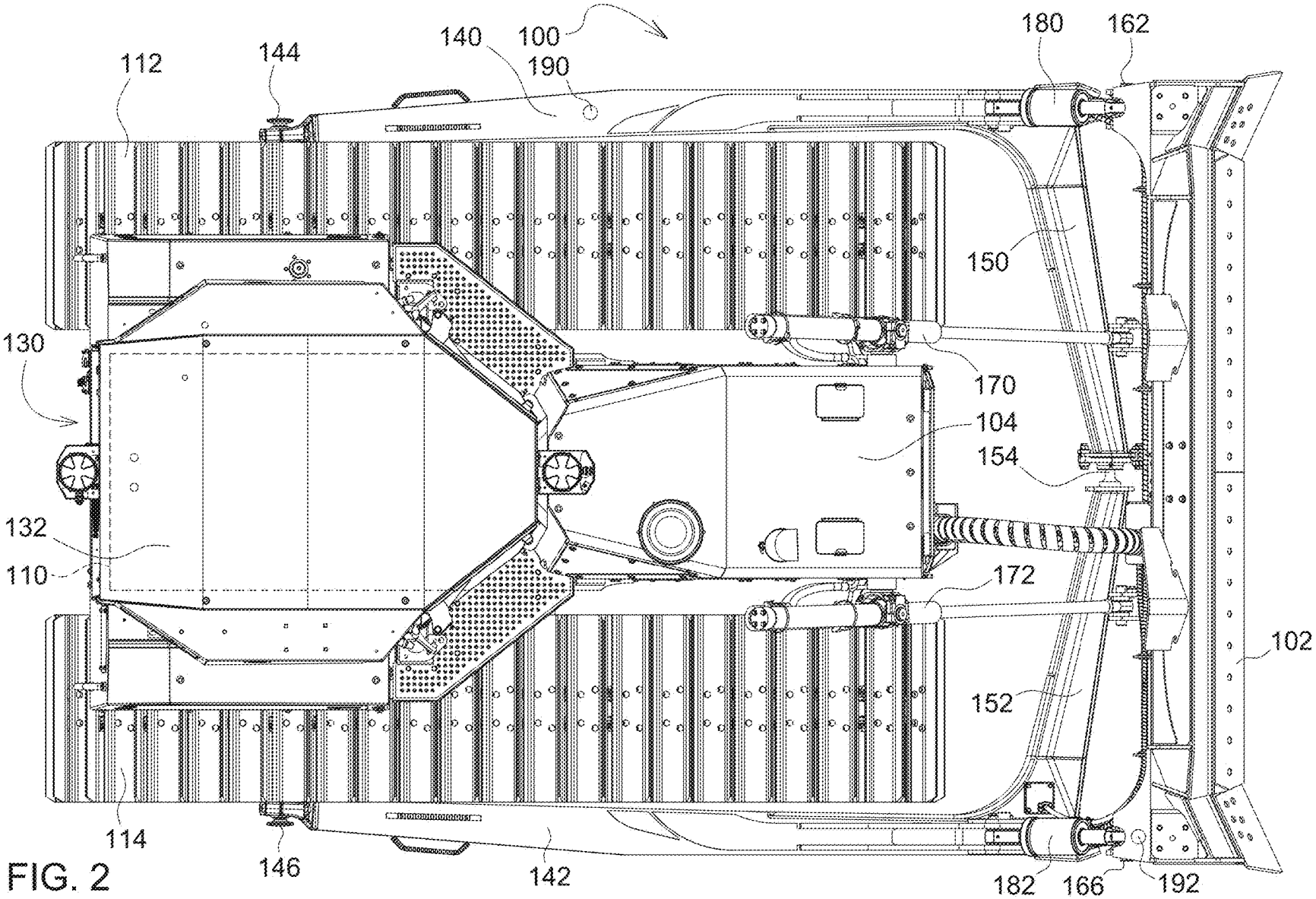
FIG. 2 is a top plan view of the work machine of FIG. 1.
Figure 3:
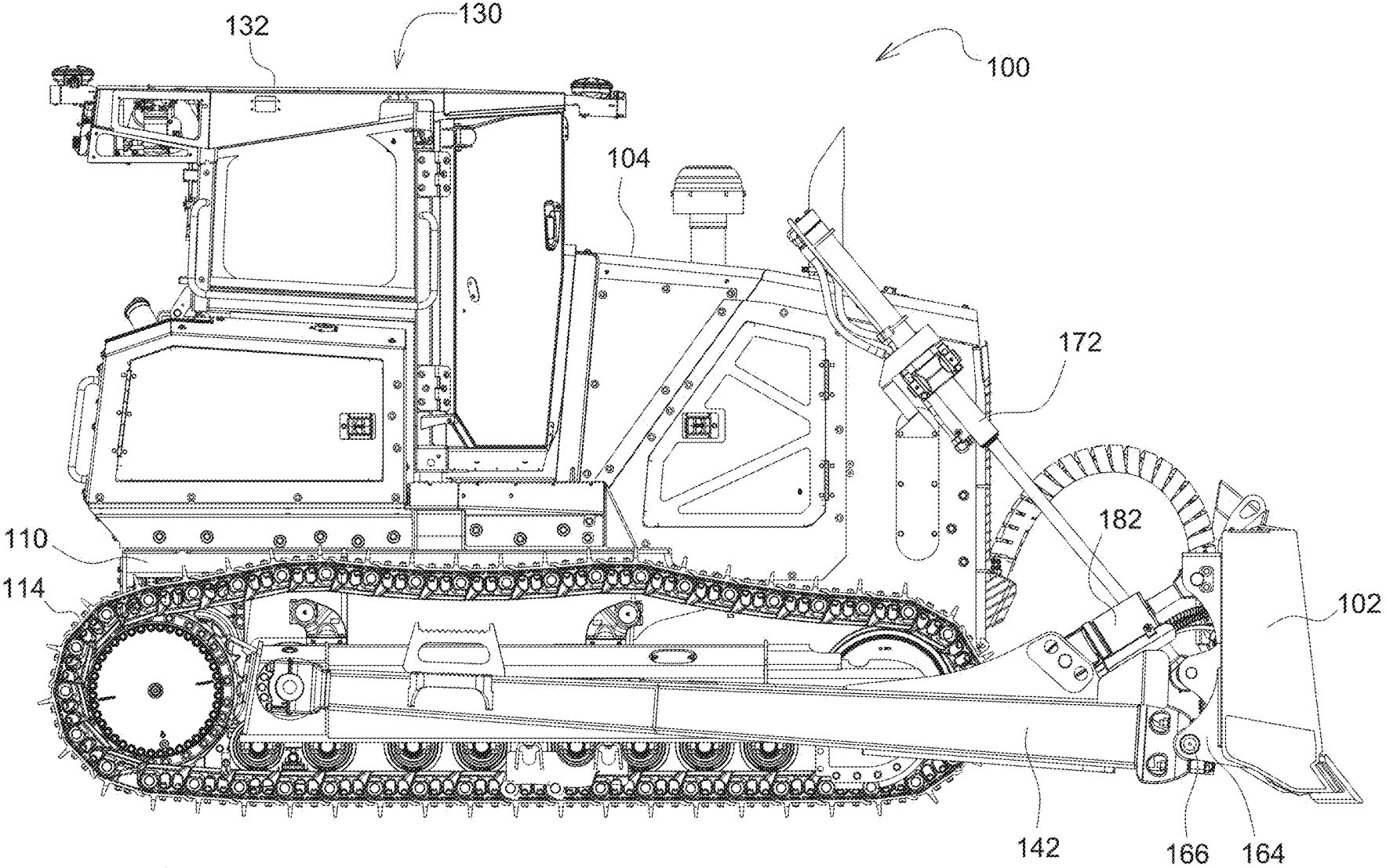
FIG. 3 is a right side elevational view of the work machine of FIG. 1.

FIG. 1 is a perspective view of a work machine 100. FIG. 2 is a top plan view of the work machine of FIG. 1. FIG. 3 is a right side elevational view of the work machine of FIG. 1. In the illustrated embodiment, the work machine is a crawler dozer, but can be any work machine with a front-mounted ground-engaging work implement such as a blade 102. Other work machines having front-mounted ground-engaging blades can also incorporate the features disclosed herein. The work machine can be operated to engage the ground to grade, cut, and move material to achieve simple or complex features on the ground. The work machine includes an engine compartment 104, which houses an engine 106 (shown schematically in FIG. 5) in a conventional manner. The engine can be an internal combustion engine (e.g., a diesel engine) or other power source.

In the illustrated embodiment, the work machine 100 is supported on the ground by an undercarriage 110. The undercarriage includes a first ground engaging unit 112 and a second ground engagement unit 114, which, in the present example, are formed by a left track and a right track, respectively. The tracks provide tractive force for the work machine. In alternative embodiments, the ground engaging units can comprise wheels on the left side and the right side of the work machine.

The undercarriage 110 is affixed to and provides support and tractive effort for a main frame 130 of the work machine 100. The main frame is the frame that provides structural support and rigidity to the work machine. In the illustrated embodiment, the main frame is a weldment comprising multiple formed and joined steel members. In alternative embodiments, the main frame can comprise any number of different materials or configurations. In the illustrated embodiment, the main includes an operator's cab 132.

As used herein, directions with regard to the work machine 100 are referred to from the perspective of an operator seated within the operator's cab 132. In the illustrated embodiment, the operator's cab is mounted on the main frame 130 so that the operator's cab faces forward in the working direction of the working implement. The left of the work machine is to the left of the operator. The right of the work machine is to the right of the operator. The front or forward end of the work machine is the direction the operator faces. The rear or aft end of the work machine is behind the operator. The top of the work machine is above the operator. The bottom of the work machine is below the operator.

The undercarriage 110 further supports a left push frame 140 and a right push frame 142. A rearmost portion of the left push frame is pivotally coupled to the undercarriage at a left push frame pivot 144. A rearmost portion of the right push frame is pivotally coupled to the undercarriage at a right push frame pivot 146 (FIG. 3). A left crossmember 150 and a right crossmember 152 interconnect frontmost portions of the left push frame and the right push frame at a central location 154.

The blade 102 includes a left blade support 160, which is pivotally coupled to the left push frame 140 at a left blade pivot 162. The blade includes a right blade support 164, which is pivotally coupled to the right push frame 142 at a right blade pivot 166.

A left push frame elevation actuator 170 is coupled between the main frame 130 and the left crossmember 150. A right push frame elevation actuator 172 is coupled between the right crossmember 152 and the frame. In the illustrated embodiment, the elevation actuators are hydraulic actuators. Extending the elevation actuators causes the elevations of the frontmost portions of the push frames to lower. Retracting the elevation actuators causes the elevations of the frontmost portions of the push frames to rise.

A left blade pitch actuator 180 is coupled between a top left portion of the blade 102 and the left push frame 140. A right blade pitch actuator 182 is coupled between a top right portion of the blade and the right push frame 142. In the illustrated embodiment, the blade pitch actuators are hydraulic actuators. Extending the blade pitch actuators causes the top portion of the blade to pitch forward (away from the main frame 130) about the left blade pivot 162 and the right blade pivot 166. Retracting the blade pitch actuators causes the top portion of the blade to pitch rearward (toward the main frame).

The positioning of the blade 102 with respect to the main frame 130 of the work machine 100 can be sensed by a plurality of sensors. For example, the illustrated embodiment includes one or more blade elevation sensors 190 (shown schematically in FIG. 1 and FIG. 4) that sense the elevation of the blade caused by operation of the left push frame elevation actuator 170 and the right push frame elevation actuator 172. One or more blade orientation sensors 192 (shown schematically in FIG. 1 and FIG. 4) sense the orientation of the blade as a result of selectively pitching the blade using the left blade pitch actuator 180 and the right blade pitch actuator 182. The blade elevation sensors and the blade orientation sensors can be inertial measurement units (IMUs), tilt sensors, distance measurement sensors, or the like, or any combination of such sensors. For example, when the actuators are implemented as hydraulic cylinders, the blade elevation sensors and the blade orientation sensors can measure the extension or retraction of the various cylinders so that the elevation and the orientation of the blade can be calculated. Alternatively, or additionally, the blade position sensors can measure the position of various locations of the blade directly and determine the elevation and orientation of the blade.

Figure 4:
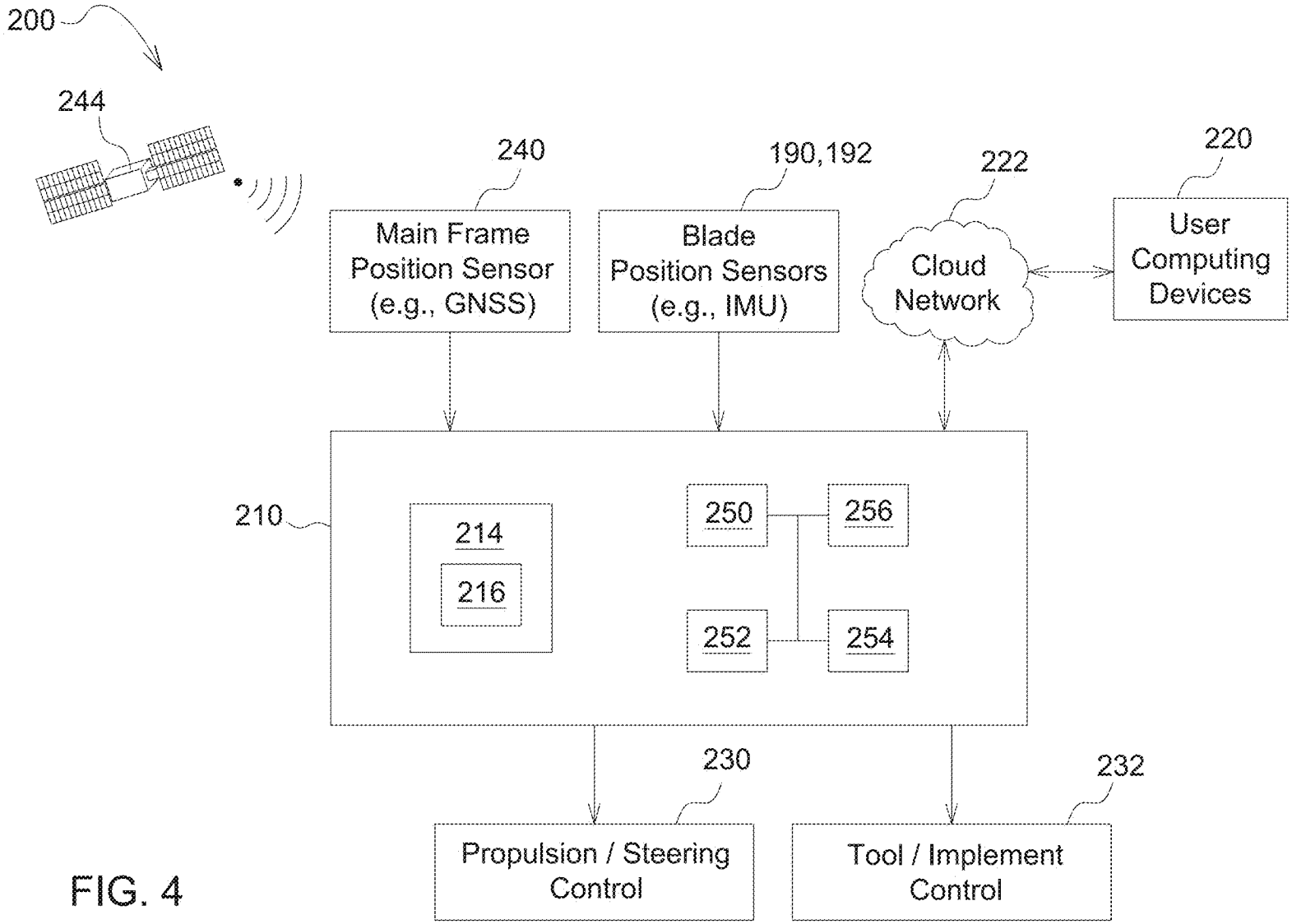
FIG. 4 is a block diagram representing an exemplary control system according to an embodiment of the present disclosure.

As illustrated schematically in FIG. 4, the work machine 100 includes a control system 200. The control system includes a controller 210. The controller can be part of the machine control system of the work machine, or the controller can be a separate control module.

As shown in FIG. 4, the controller 210 can include or be functionally linked to a user interface 214, which can be mounted in the operators cab 132 at a control panel (not shown). The user interface as used herein can include, or can take the form of, a display unit 216 and/or other outputs from the system such as indicator lights, audible alerts, and the like. The user interface can further or alternatively include various controls or user inputs (e.g., a steering wheel, joysticks, levers, buttons) for operating the work machine 100, including operation of the engine 106, hydraulic cylinders (described above), and the like. The onboard user interface can be coupled to a vehicle control system via, for example, a control area network (CAN) bus arrangement or other equivalent forms of electrical or electromechanical signal transmission. Another form of user interface (not shown) can take the form of a display unit that is generated on a remote (i.e., not onboard) user computing device 220 based on signals received via, for example, a cloud network 222, which can display outputs such as status indications. The user computing device can enable user interaction such as the providing of inputs to the system. In the context of a remote user interface, data transmission between, for example, the work machine control system and the user interface may take the form of a wireless communications system and associated components as are conventionally known in the art. In certain embodiments, a remote user interface and vehicle control systems for respective work machines can be further coordinated or otherwise interact with a remote server or other computing device for the performance of operations in a system as disclosed herein.

The controller 210 can generate control signals for controlling the operation of various actuators throughout the work machine 100, which can be, for example, hydraulic motors, hydraulic piston-cylinder units, electric actuators, or the like, including the hydraulic cylinders described above. The various actuators may for example be associated with a propulsion/steering control unit 230, a work tool/implement control unit 232, and the like. The work tool/implement control unit is further described below with respect to FIG. 5. The work tool/implement control unit can comprise, for example, the left push frame elevation actuator 170, the right push frame elevation actuator 172, the left blade pitch actuator 180, the right blade pitch actuator 182, and additional and/or equivalent structures associated with actuation of the blade in the lift and pitch directions. Electronic control signals from the controller can be, for example, received by electrohydraulic control valves associated with respective actuators, wherein the electrohydraulic control valves control the flow of hydraulic fluid to and from the respective hydraulic actuators to control the actuation thereof in response to the control signal from the controller.

The controller 210 is configured to receive input signals from some or all of the blade elevation sensors 190 and the blade orientation sensors 192 associated with the elevation and the orientation of the blade 102. The controller is further configured to receive input signals from one or more work machine position sensors 240 associated with the position and orientation of the work machine 100. The blade elevation sensors, the blade orientation sensor, and the work machine position sensors can be discrete in nature, but signals representative of more than one input parameter relevant to the respective positions and/or orientations of the work machine, the blade, or both can be provided from the same sensor. The signals from the sensors disclosed herein can include or otherwise can refer to signals provided from the machine control system.

The work machine position sensors 240 are configured to provide a signal indicative of the inclination of the main frame 130 of the work machine 100 relative to the direction of gravity, which is an angular measurement in a work machine pitch direction. This signal can be referred to as a main frame pitch angle signal. The work machine position sensor can also be configured to provide a signal or signals indicative of other positions or velocities of the main frame, including one or more of the angular position, the velocity, or the acceleration in a direction such as a work machine tilt (roll) direction, the work machine pitch direction, and a work machine yaw direction. The work machine position sensor can also be configured to output one or more signals responsive to linear acceleration or the work machine in one or more of a longitudinal direction (e.g., along a work machine longitudinal centerline), a lateral direction (e.g., along a work machine lateral centerline), and a vertical direction (e.g., along a work machine vertical centerline). The work machine position sensor can be configured to directly measure inclination, measure angular velocity, and integrate the measurements to arrive at inclination. The work machine position can also measure inclination to derive an angular velocity.

In the illustrated embodiment, the work machine position sensors 240 can comprise one or more inertial measurement units (IMUs) mounted on the main frame 130. The IMUs are configured to provide at least a main frame pitch angle signal and an angular velocity signal to the controller 210 as inputs for the control method as further disclosed below. Such IMUs can, for example, be in the form of a three-axis gyroscopic unit configured to detect changes in orientation of the sensor, and thus of the main frame to which it is fixed, relative to an initial orientation.

In an alternative embodiment, the one or more work machine position sensors 240 can comprise at least one global navigation satellite system (GNSS) (e.g., a global positioning system (GPS)) receiver fixed relative to the main frame 130. The GNSS receiver can detect the absolute position and orientation of the main frame in a global three-dimensional coordinate system by way of communications with one or more satellites 244, and can detect changes in the position and orientation and orientation of the main frame. By combining the position of the main frame of the work machine with the positioning and orientation of the blade 102 with respect to the main frame determined as described above, the position and orientation of the blade in the three-dimensional global coordinate system can be determined. Alternative, a GNSS receiver may be affixed directly to the so that the spatial position and orientation of one or more points of interest on the blade can be determined directly in a three-dimensional global coordinate system.

In certain embodiments, the controller 210 can include or can be associated with a processor 250, a computer-readable medium 252, a communication unit 254, and a data storage system 256 such as for example a database network along with the previously described user interface 214 and display unit 216. An input/output device, such as a keyboard, joystick or other user interface tool, can be provided so that a human operator may input instructions to the controller. The controller described herein can be a single controller having all of the described functionality, or the controller can include multiple controllers wherein the described functionality is distributed among the multiple controllers.

Various operations, steps or algorithms as described in connection with the controller 210 can be embodied directly in hardware, in a computer program product such as a software module executed by a processor, or in a combination of the two. The computer program product can reside in RAM memory, flash memory, ROM memory, EPROM memory, EEPROM memory, registers, hard disk, a removable disk, or any other form of computer-readable medium known in the art. The exemplary computer-readable medium 252 can be coupled to the processor 250 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" 250 as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

The communication unit 254 may support or provide communications between the controller 210 and external systems or devices, for example via the cloud network 222, and/or support or provide communication interface with respect to internal components of the work machine 100. The communications unit can include wireless communication system components (e.g., via cellular modem, via a Wi-Fi® connection, via a Bluetooth® connection, or the like). The communications unit can include one or more wired communications terminals such as universal serial bus ports.

Unless otherwise stated, the data storage system 256 can generally encompass hardware such as volatile or non-volatile storage devices, drives, memory, or other storage media, as well as one or more databases residing thereon.

Figure 5:
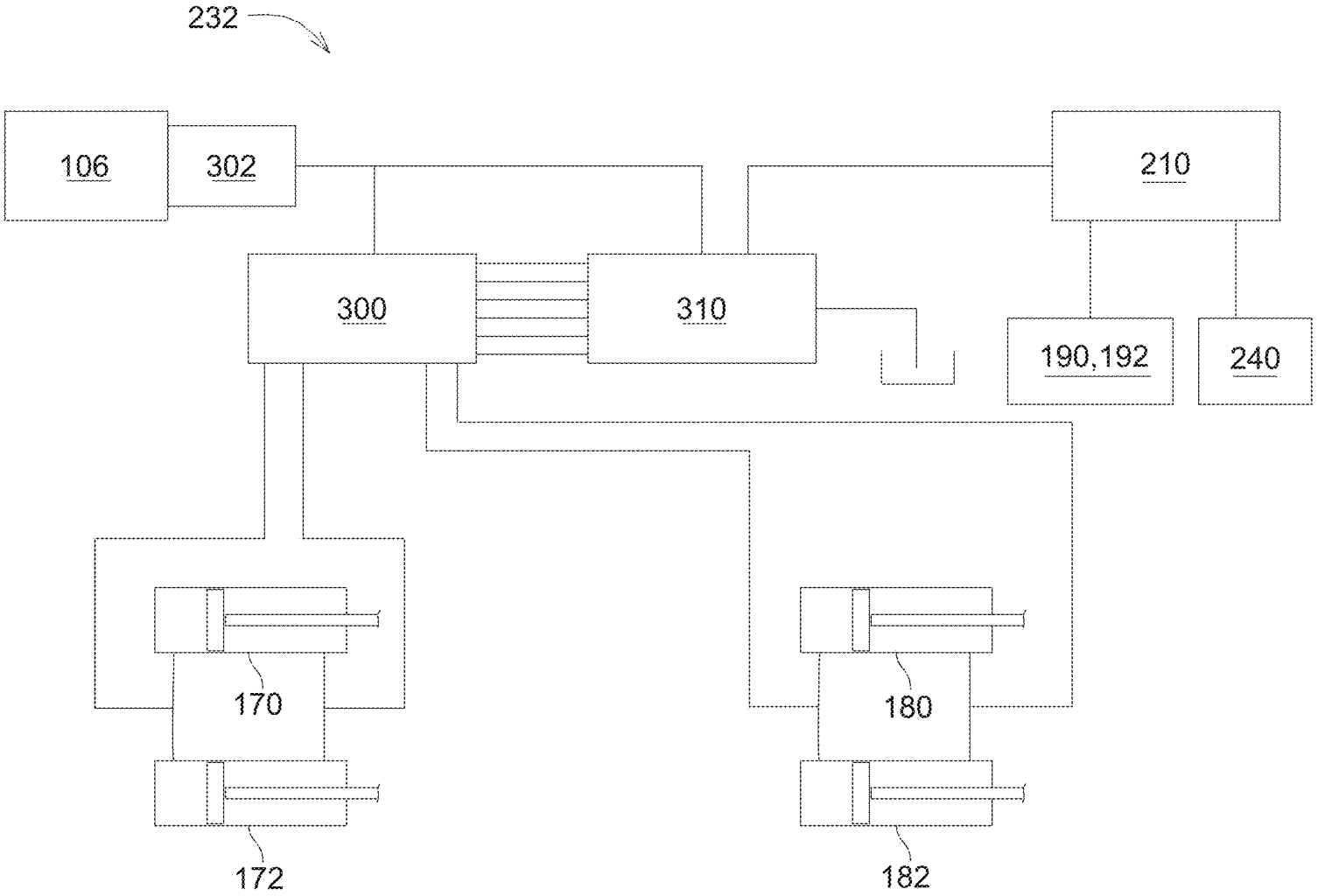
FIG. 5 is a block diagram of an exemplary tool/implement control unit according to the embodiment of the work machine of FIGS. 1-3 and the control system of FIG. 4.

FIG. 5 is an illustrative schematic block diagram of the work tool/implement control unit 232. The control unit includes, for example, hydraulic and electrical components for controlling a position of the blade 102. Each of the left push frame elevation actuator 170, the right push frame elevation actuator 172, the left blade pitch actuator 180, and the right blade pitch actuator 182 is hydraulically connected to a hydraulic control valve 300, which may be positioned in an interior area of the work machine 100. The hydraulic control valve may also be referred to as a valve assembly or manifold. The hydraulic control valve receives pressurized hydraulic fluid from a hydraulic pump 302, which may be rotationally connected to the engine 106, and directs the hydraulic fluid to the elevation actuators, the pitch actuators, and other hydraulic circuits or functions of the work vehicle. The hydraulic control valve may meter the hydraulic fluid out, or control the flow rate of hydraulic fluid to each hydraulic circuit to which it is connected. In alternative embodiments, the hydraulic control valve does not meter the hydraulic fluid out but instead only selectively provides flow paths to these functions while metering is performed by another component (e.g., a variable displacement hydraulic pump). In further alternative embodiments, metering not performed at all. The hydraulic control valve can meter the hydraulic fluid out through a plurality of spool valves (not shown), which have positions that control the flow of hydraulic fluid and other hydraulic logic. The spool valves can be actuated by solenoids, pilots (e.g., pressurized hydraulic fluid acting on the spool valve), the pressure upstream or downstream of the spool valve, or some combination of these element and other elements.

In accordance with the embodiment illustrated in FIGS. 1-3, the spool valves of the hydraulic control valve 300 are shifted by pilots whose pressure is controlled, at least in part, by an electrohydraulic pilot valve 310 in communication with the controller 210. The electrohydraulic pilot valve is positioned within an interior area of the work machine 100 and receives pressurized hydraulic fluid from a hydraulic source and selectively directs such fluid to pilot lines hydraulically connected to the hydraulic control valve. In this embodiment the hydraulic control valve and the electrohydraulic pilot valve are separate components, but in alternative embodiments the two valves may be integrated into a single valve assembly or manifold. In this embodiment, the hydraulic source is the hydraulic pump 302. In alternative embodiments, a pressure reducing valve (not shown) can be used to reduce the pressure of pressurized hydraulic fluid provided by the hydraulic pump to a set pressure, for example 600 pounds per square inch, for usage by the electrohydraulic pilot valve.

In the embodiment illustrated in FIG. 5, individual valves within the electrohydraulic pilot valve 310 reduce the pressure from the received hydraulic fluid via solenoid-actuated spool valves (not shown) that can drain hydraulic fluid to a hydraulic reservoir. In the illustrated embodiment, the controller 210 actuates the solenoids by sending a specific current to each (e.g., 600 mA). In this way, the controller can actuate the blade 102 by issuing electrical commands signals to the electrohydraulic pilot valve, which in turn provides hydraulic signals (pilots) to the hydraulic control valve, which shift spool valves to direct hydraulic flow from the hydraulic pump to actuate the left push frame elevation actuator 170, the right push frame elevation actuator 172, the left blade pitch actuator 180, and the right blade pitch actuator 182. In the illustrated embodiment, the controller is in direct communication with the electrohydraulic pilot valve via electrical signals sent through a wire harness and is indirectly in communication with the hydraulic control valve via the electrohydraulic pilot valve.

In alternative embodiments, the controller 210 may send a command to actuate the blade 102 in a number of different manners. As one example, the controller may be in communication with a valve controller via a controlled area network (CAN) and may send command signals to the valve controller in the form of CAN messages. The valve controller may receive these messages from the controller and send current to specific solenoids within the electrohydraulic pilot valve 310 based on those messages. As another example, the controller may actuate the blade by actuating an input in the operator's cab 132. For example, an operator may use a joystick to issue commands to actuate the blade, and the joystick may generate hydraulic pressure signals, pilots, which are communicated to the hydraulic control valve 300 to cause the actuation of the blade. In such a configuration, the controller can be in communication with electrical devices (e.g., solenoids, motors) that can actuate a joystick in the operator's cab. In this way, the controller can actuate the blade by actuating these electrical devices instead of communicating signals to electrohydraulic pilot valve.

Figure 6:
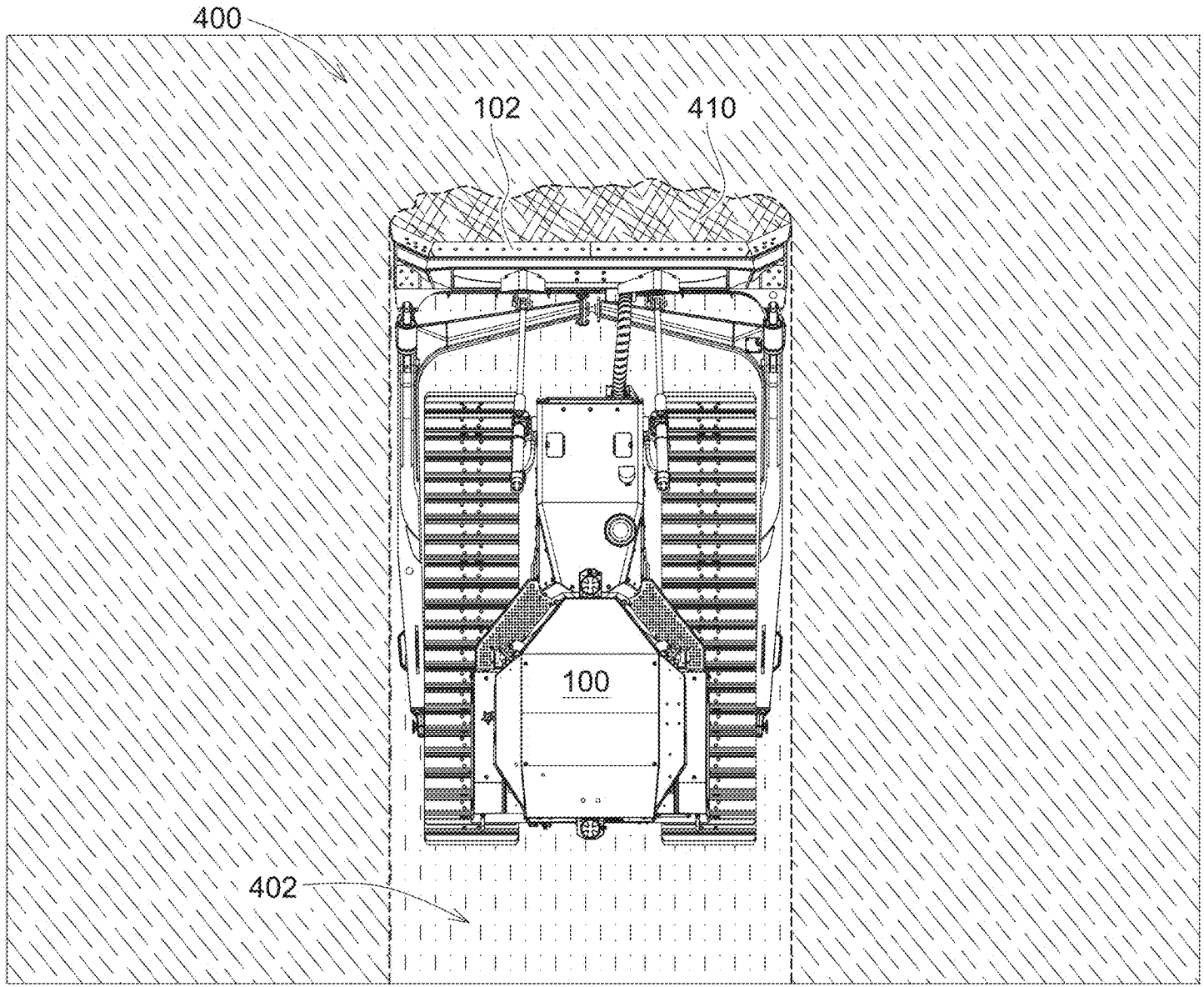
FIG. 6 is a pictorial illustration of the work machine of FIGS. 1-3 creating a graded slot in a ground surface.

FIG. 6 illustrates a pictorial representation of the work machine (dozer) 100 cutting a slot 402 in the surface of a plot 400 using the blade 102. As the blade cuts into the surface, dislodges soil (or other material) accumulates as a mass 410 in front of the blade. The blade causes the slot to form behind the blade.

The creation of the slot 402 includes at least three distinct phases. At the beginning of each pass over the surface where the slot is formed, the operator aligns the work machine 100 with the intended path of the slot and lowers the blade 102 to the surface. The operator then initiates forward movement of the work machine along the intended path. The operator lowers the blade further to penetrate the surface and initiate cutting. After initiating the cut, the operator raises the blade to a track plane (described below) and continues dislodging material. The dislodged material rises onto the front surface of the blade and is carried forward as the mass 410 while additional material is dislodged with further forward movement of the work machine. When the blade is full of dislodged material, the operator elevates the blade. The system and method respond to the elevation of the blade to pitch the top of the blade to the rear (toward the front of the work machine), to orient the blade at a carry angle (described below) to cause the dislodged material to be retained on the front surface of the blade. The dislodged material is carried forward on the front surface of the blade until the work machine reaches a destination location for the material where the dislodged material on the front surface of the blade is shed by pitching the top of the blade forward (away from the front of the work machine) to orient the blade at a shedding angle (described below). The foregoing process is repeated as needed to make the slot deeper and longer on subsequent passes.

Figure 9:
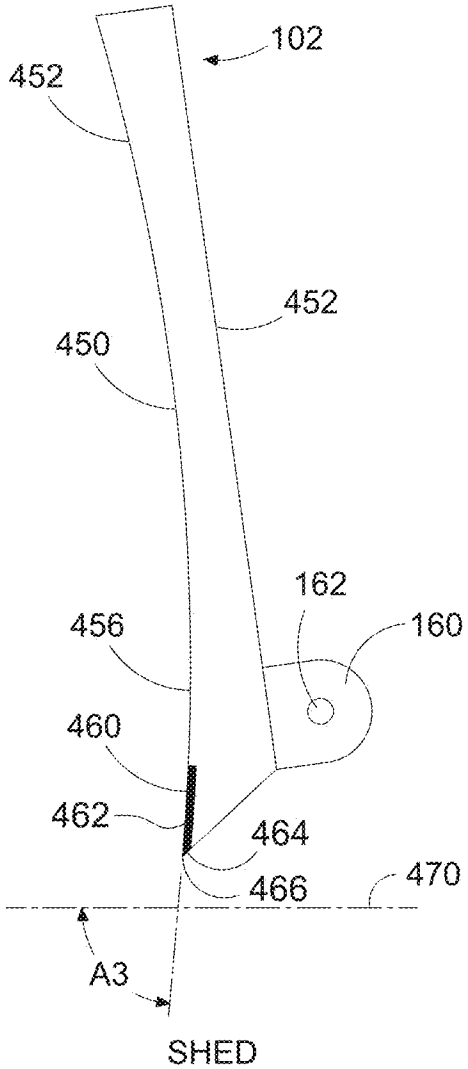
FIG. 9 is a left side elevational view of the blade of the work machine of FIGS. 1-3 showing the blade in a forward pitch position with the cutting edge of the blade oriented at a shedding angle shedding dislodged surface material from the blade.
Figure 8:
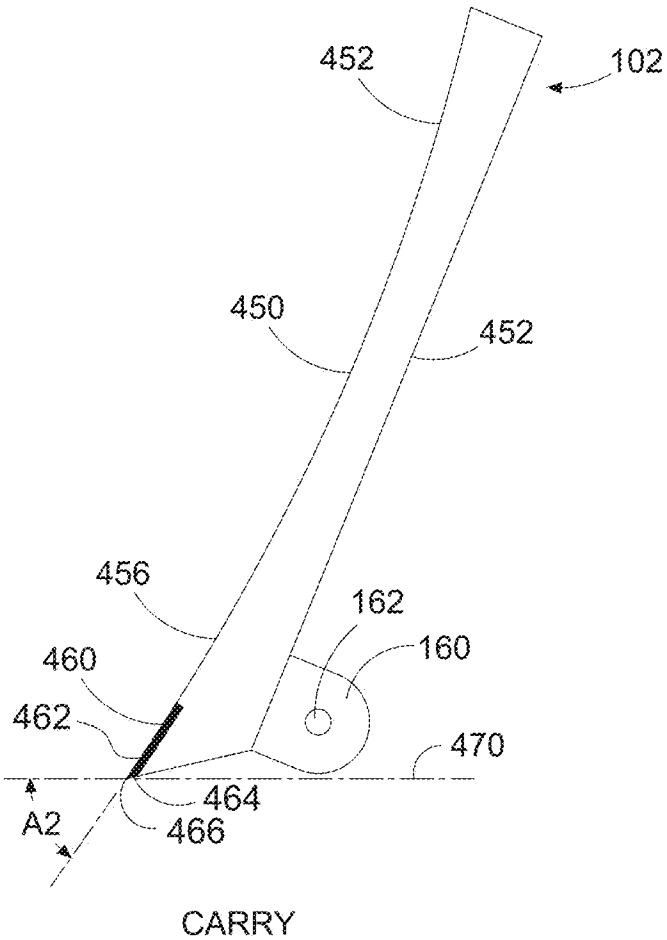
FIG. 8 is a left side elevational view of the blade of the work machine of FIGS. 1-3 showing the blade in a rearward pitch position with the cutting edge of the blade oriented at a carry angle for continual cutting and for carrying dislodged surface material.
Figure 7:
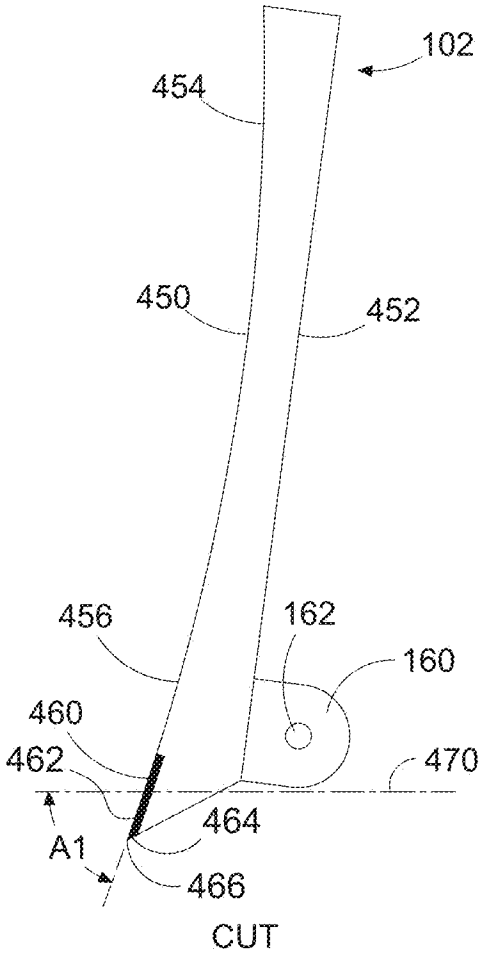
FIG. 7 is a left side elevational view of the blade of the work machine of FIGS. 1-3 showing the blade in a midway pitch position with the cutting edge of the blade oriented at a cutting angle for initial surface penetration.

FIGS. 7-9 illustrate left side elevational views of the blade 102 to assist in explaining the effect of pitching the blade. The views in FIGS. 7-9 show the blade with a curved front surface 450 and a rear surface 452. The left blade support 160 and the right blade support 164 on the rear surface of the blade are pivotally coupled to the respective front portions of the left push frame 140 and the right push frame 142 at the respective left blade pivot 162 and right blade pivot 166. Only the left blade support and the left blade pivot are shown in FIGS. 7-9. An upper blade portion 454 and a lower blade portion 456 are defined relative to the left blade pivot and pitch in opposite directions about the left blade pivot. The pitch of the blade is controlled by the controller 210 (FIG. 5). When the upper portion of the blade is pitched rearward (toward the front of the work machine 100), the lower portion of the blade is pitched forward (away from the front of the work machine) as shown in FIG. 8. This pitch position is referred to as a rearward pitch position based on the position of the upper portion of the blade. When the upper portion of the blade is pitched forward (away from the front of the work machine), the lower portion of the blade is pitched rearward (toward the front of the work machine) as shown in FIG. 9. This pitch position is referred to as a forward pitch position based on the position of the upper portion of the blade. FIG. 7 illustrates the blade in a midway pitch position wherein the upper portion of the blade is between the rearward pitch position of FIG. 8 and the forward pitch position of FIG. 9. Although shown as approximately halfway between the rearward pitch position and the forward pitch position, the midway pitch position can be in a range of pitch positions between the two boundary pitch positions.

As shown in FIG. 1 and in FIGS. 7-9, the lower portion 456 of the blade 102 supports a cutting plate 460 having a front surface 462 that engages the ground surface into which the slot 402 is to be formed. The cutting plate includes a lowermost tapered portion 464 such that the lowest end of the front surface forms a cutting edge 466 that enables the cutting edge and at least a portion of the cutting plate to penetrate the surface to be sculpted. In the illustrated embodiment, the cutting plate of the blade is removable and replaceable when the cutting edge or another portion of the cutting plate becomes worn or damaged. Accordingly, the cutting edge of the blade is removable and replaceable by removing and replacing the cutting plate. The cutting plate of the blade can be a single unit across the lower portion of the blade; however, in the illustrated embodiment, the cutting plate comprises multiple segments that can be removed and replaced individually based on wear or damage of the respective segments.

The cutting edge 466 of the blade 102 forms a cutting edge angle with respect to surface to be sculpted. As shown in FIGS. 7-9, the cutting edge angle is defined with respect to a track plane 470, which defines the desired surface to be created by the grading operation. The track plane forms one side of the cutting plane angle. The cutting edge angle is further defined with respect to the orientation of the front surface 462 of the cutting plate 460 adjacent to the cutting edge. If the front surface of the cutting plate adjacent to the cutting edge is substantially flat (e.g., planar), the plane of the front surface defines a second side that forms the cutting edge angle with respect to the track plane. If the front surface is curved adjacent to the cutting edge, a plane tangential to the front surface at the cutting edge defines the second side of the cutting edge angle.

The cutting edge angle varies with the pitch position of the blade 102. As shown in FIG. 7 for the midway pitch position, the cutting edge 466 is oriented at a first angle A1 with respect to the track plane 470. As discussed below, the first angle A1 is the "cutting angle" of the cutting edge.

As shown in FIG. 8 for the rearward pitch position, the cutting edge 466 is oriented at a second angle A2 with respect to the track plane 470. As discussed below, the second angle A2 is the "carry angle" of the cutting edge.

As shown in FIG. 9, for the forward pitch position, the cutting edge 466 is oriented at a third angle A3 with respect to the track plane 470. As discussed below, the third angle A3 is the "shedding angle" of the cutting edge.

When performing the slot-cutting procedure described above, the controller 210 controls the pitch of the blade 102 to a different pitch position for each phase of the procedure. When the operator initiates forward movement of the work machine 100 and the blade is lowered toward the ground surface, the controller automatically adjusts the pitch of the blade to the midway pitched position of FIG. 7. The cutting angle A1 is selected such that the cutting edge 466 of the cutting plate 460 is oriented at a steep—but not perpendicular angle—with respect to the track plane 470 so that the cutting edge penetrates the surface and is forced downward as the work machine 100 moves forward.

After the cutting edge 466 of the cutting plate 460 penetrates the surface and initiates the cut in the first phase of the procedure, the blade 102 is elevated to return the cutting edge to the elevation of the track plane 470 so that the cutting edge forms a graded surface at the elevation of the track plane. When the blade is elevated, the controller automatically adjusts the pitch of the blade to the rearward pitch position of FIG. 8 so that the cutting edge of the blade is oriented at the carry angle A2. The carry angle is selected so that the cutting edge continues to dislodge material; however, the smaller carry angle reduces the downward force so that the cutting edge does not tend to descend further. Furthermore, the front surface 450 of the blade is oriented at a shallower angle so that previously dislodged material can ascend the front surface as more material is dislodged and pushes upward on the previously dislodged material.

When the slot-cutting procedure for a pass ends, the blade 102 is raised to elevate the cutting edge 466 of the cutting plate 460 above the track plane 470 to discontinue dislodging new material from the surface. The controller 210 responds to increased elevation of the blade by automatically adjusting the pitch of the blade to the shedding angle A3 as shown in FIG. 9. The shedding angle is selected so that the orientation of the cutting edge is at a steep angle to the track plane and the front surface 450 is positioned forward of the cutting edge so that the dislodged material carried by the blade readily falls off the blade and is deposited at a discharge location.

Figure 10:
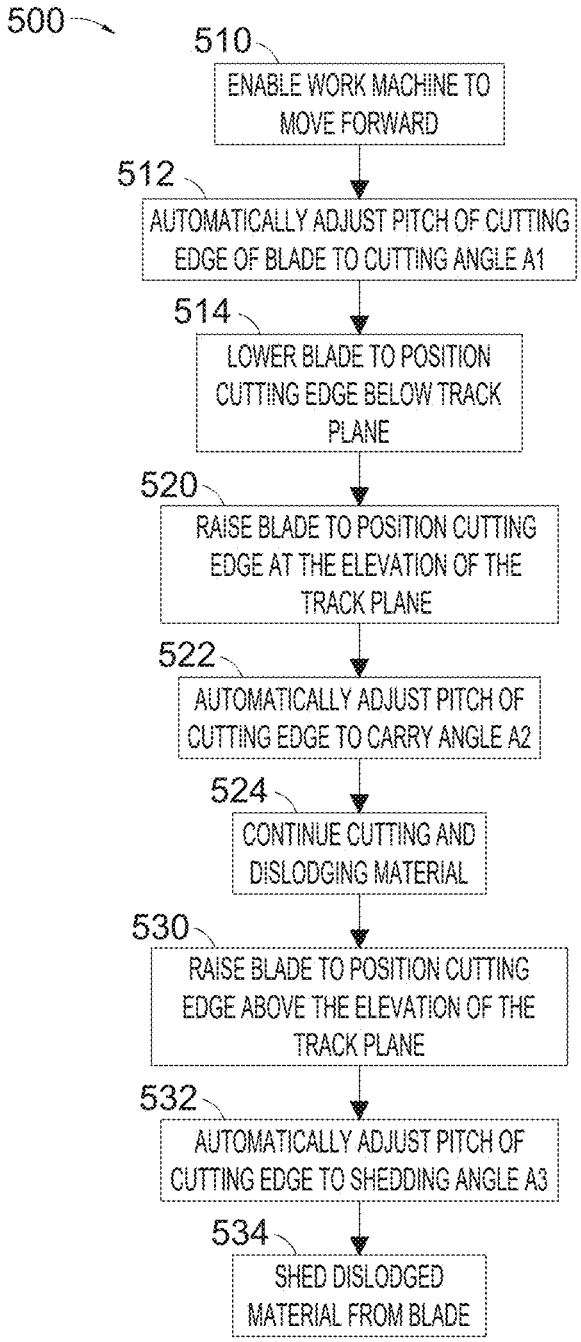
FIG. 10 is flowchart representing an exemplary embodiment of a method as disclosed herein.

The algorithm for controller 210 to implement the above-described control of the pitch of the blade 102 is illustrated in FIG. 10 by a flowchart 500.

In a first step 510 of the algorithm, the work machine is enabled to move forward. In a second step 512, the controller 210 automatically adjusts the pitch of the blade 102 to orient the cutting edge 466 at the cutting angle A1. In a third step 514, the elevation of the blade is lowered so that the cutting edge descends below the track plane.

In a fourth step 520 of the algorithm, the blade 102 is elevated so that the cutting edge 466 is at the elevation of the track plane 470. The controller automatically adjusts the pitch of the blade to orient the cutting edge at the carry angle A2 in a fifth step 522. In sixth step 524, the blade continues cutting and dislodging material until the current grading swath is completed.

When the current grading swath is completed, the blade 102 is raised to elevate the cutting edge 466 above the track plane 470 in a seventh step 530. In an eighth step 532, the controller 210 automatically adjusts the pitch of the blade to orient the cutting edge at the shedding angle A3. In an ninth step 534, the material is shed from the front surface 450 of the blade so that the working machine can start a new swath with little or no dislodged material on the blade from the completed swath.

Automatically controlling the pitch of the blade 102 relieves the operator of the pitch control tasks so that the operator can concentrate on maintaining the work machine on the track plane.

The system and method disclosed herein can detect and counter bridging of the dozer. Bridging can occur when the surface being sculpted is very hard such that the cutting edge 466 of the blade 102 is not able to penetrate the surface. Thus, as the blade is lowered, the front portion of the work machine 100 raises such that a respective front portion of one or both of the first and second ground engagement units 112, 114 is lift off the surface, which causes the work machine to have reduced traction. The bridging also causes an inclination in the work machine, which is detected by the work machine position sensors 240. The system and method counter the bridging by pitching the upper portion of the blade forward to increase the cutting angle A1 (FIG. 7).

As used herein, the phrase "one or more of," when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A computer-assisted method of controlling the pitch of a blade of a work machine comprising:

initiating movement of the work machine in a forward direction along a surface to be modified by the blade of the work machine;

responding to the movement of the work machine by automatically changing the pitch of the blade to a first pitch such that a cutting edge of the blade is at a cutting angle with respect to the surface being modified;

lowering the blade to position the cutting edge below an elevation of a track plane to initiate cutting of the surface to be modified;

raising the blade to position the cutting edge at the elevation of the track plane;

responding to the cutting edge rising to the elevation of the track plane by automatically changing the pitch of the blade to a second pitch such that the cutting edge is at a carry angle with respect to the surface being modified;

raising the blade to position the cutting edge above the elevation of the track plane; and responding to the cutting edge rising above the elevation of the track plane by automatically changing the pitch of the blade to a third pitch such that the cutting edge is at a shedding angle with respect to the surface being modified.

2. The method as defined in claim 1 wherein the carry angle is less than the cutting angle and the shedding angle is greater than the cutting angle.

3. The method as defined in claim 1 wherein:

the blade is supported at a pivot location of a support structure extending from the work machine and wherein:

the blade has an upper portion and a lower portion, the cutting edge positioned at the lower portion, the upper portion at a first upper portion position and the lower portion at a first lower portion position when the blade is at the first pitch;

changing the pitch to the second pitch moves the upper portion of the blade to a second upper portion position toward the front of the work machine and positions the lower portion of the blade to a second lower portion position away from the front of the work machine;

changing the pitch to the third pitch moves the upper portion of the blade to a third upper portion position away from the front of the work machine and positions the lower portion of the blade to a third lower portion position toward the front of the work machine; and changing the pitch to the first pitch moves the upper portion of the blade to the first upper portion position between the second upper portion position and the third upper portion position, and moves the lower portion of the blade to the first lower portion position between the second lower portion position and the third lower portion position.

4. The method as defined in claim 1 further comprising:

detecting bridging of the work machine wherein at least a portion of at least one ground engaging unit of the work machine is elevated above the surface being modified; and automatically changing the pitch of the blade to increase the angle of the cutting edge and to thereby counter the bridging.

5. The method as defined in claim 1 wherein the cutting edge of the blade is removably attached to the lower portion of the blade.

6. A control system for operating a work machine comprising a plurality of ground-engaging units, which support a machine frame and which are driven to cause the work machine to travel across a ground surface, the work machine further comprising a blade supported by a support structure extending from the machine frame, the blade having an upper portion and a lower portion, the lower portion supporting a cutting edge configured to sculpt the ground surface along a track plane, wherein the control system comprises:

a controller configured to:

receive signals from the work machine indicating the movement of the work machine and signals indicating changes in elevation of the blade;

generate signals to control the work machine and to control the pitch of the blade;

respond to forward movement of the work machine by adjusting the pitch of the blade to a first pitch such that the cutting edge is at a cutting angle with respect to the surface being sculpted;

respond to the cutting edge being lowered below the track plane and then being raised to the elevation of the track plane by adjusting the pitch of the blade to a second pitch such that the cutting edge is at a carry angle with respect to the surface to being sculpted; and respond to the cutting edge rising above the track plane by adjusting the pitch of the blade to a third pitch such that the cutting edge is at a shedding angle with respect to the surface being sculpted.

7. The control system as defined in claim 6 wherein the carry angle is less than the cutting angle and the shedding angle is greater than the cutting angle.

8. The control system as defined in claim 6 wherein the controller is configured to:

adjust the pitch of the blade to the second pitch by moving the upper portion of the blade to a rearward upper portion position toward the front of the work machine and by moving the lower portion of the blade to a forward lower portion position away from the front of the work machine;

adjust the pitch of the blade to the third pitch by moving the upper portion of the blade to a forward upper portion position away from the front of the work machine and by moving the lower portion of the blade to a rearward lower portion position toward the front of the work machine; and adjust the pitch of the blade to the third pitch by moving the upper portion of the blade to a upper portion position between the rearward upper portion position and the forward upper portion position and by moving the lower portion of the blade to a lower portion position between the forward lower portion position and the rearward lower portion position.

9. The control system as defined in claim 6 wherein the controller is further configured to:

detect bridging of the work machine wherein at least a portion of at least one of the ground engaging units of the work machine is elevated above the surface being modified; and automatically change the pitch of the blade to increase the angle of the cutting edge and thereby counter the bridging.

10. The control system as defined in claim 6 wherein the cutting edge of the blade is removably attached to the lower portion of the blade.

11. A method of sculpting a surface along a track plane using a cutting edge of a blade of a work machine, wherein the blade is supported by a support structure extending from the work machine, wherein the blade has an adjustable pitch with respect to the support structure that enables the cutting edge of the blade to be adjustable to a selected angle with respect to the surface, the method comprising:

positioning the work machine to position the cutting edge of the blade proximate to a portion of the surface;

initiating forward movement of the work machine along the track plane;

responding to the forward movement of the work machine by automatically adjusting the pitch of the cutting edge of the blade to a cutting angle with respect to the surface and lowering the cutting edge into the surface;

raising the blade to position the cutting edge at an elevation of the track plane;

responding to the cutting edge rising to the elevation of the track plane by automatically adjusting the cutting edge of the blade to a carry angle with respect to the surface;

raising the cutting edge to an elevation above the elevation of the track plane; and responding to the cutting edge rising about the track plane by automatically adjusting the cutting edge of the blade to a shedding angle.

12. The method as defined in claim 11 wherein the carry angle is less than the cutting angle and the shedding angle is greater than the cutting angle.

13. The method as defined in claim 11 further compromising:

detecting bridging of the work machine wherein at least a portion of at least one ground engaging unit of the work machine is elevated above the surface being modified; and automatically pivoting the blade to increase the angle of the cutting edge and thereby counter the bridging.

14. The method as defined in claim 11 wherein the cutting edge of the blade is removably attached to the lower portion of the blade.

* * * * *